US009050699B2

(12) United States Patent
Chen et al.

(10) Patent No.: US 9,050,699 B2
(45) **Date of Patent: *Jun. 9, 2015**

(54) POLISHING HEAD ZONE BOUNDARY SMOOTHING

(71) Applicant: Applied Materials, Inc., Santa Clara, CA (US)

(72) Inventors: Hung Chih Chen, Sunnyvale, CA (US); Samuel Chu-Chiang Hsu, Palo Alto, CA (US); Gautam Shashank Dandavate, Sunnyvale, CA (US); Denis M. Koosau, Pleasanton, CA (US)

(73) Assignee: APPLIED MATERIALS, INC., Santa Clara, CA (US)

( * ) Notice: Subject to any disclaimer, the term of this patent is extended or adjusted under 35 U.S.C. 154(b) by 100 days.

This patent is subject to a terminal disclaimer.

(21) Appl. No.: 13/893,030

(22) Filed: May 13, 2013

(65) Prior Publication Data

US 2013/0252518 A1 Sep. 26, 2013

Related U.S. Application Data

(62) Division of application No. 12/720,893, filed on Mar. 10, 2010, now Pat. No. 8,460,067.

(60) Provisional application No. 61/178,218, filed on May 14, 2009.

(51) Int. Cl.

| | |
|---|---|
| ***B24B 5/00*** | (2006.01) |
| ***B24B 37/30*** | (2012.01) |
| ***B24B 41/06*** | (2012.01) |

(52) U.S. Cl.

CPC ..... *B24B 37/30* (2013.01); *B24B 41/06* (2013.01)

(58) Field of Classification Search

CPC ..... B24B 37/30; B24B 37/32; B24B 49/16; B24B 41/06

USPC ..... 451/285–289, 388, 397, 398

See application file for complete search history.

(56) References Cited

U.S. PATENT DOCUMENTS

| | | | |
|---|---|---|---|
| 6,769,973 | B2 | 8/2004 | Boo et al. |
| 6,776,694 | B2 | 8/2004 | Zuniga et al. |

(Continued)

FOREIGN PATENT DOCUMENTS

| | | | |
|---|---|---|---|
| CN | 1697153 | A | 11/2005 |
| CN | 1748293 | | 3/2006 |

(Continued)

OTHER PUBLICATIONS

First Office Action dated May 27, 2013 and Searh Report for Chinese Application No. 201080003356.0.

(Continued)

*Primary Examiner* — Dung Van Nguyen

(74) *Attorney, Agent, or Firm* — Patterson & Sheridan, LLP

(57) ABSTRACT

A method and apparatus for chemical mechanical polishing of substrates, and more particularly a method and apparatus related to a carrier had for use in chemical mechanical polishing is provided. In one embodiment the carrier head assembly comprises a base assembly for providing support to the substrate, a flexible membrane mounted on the base assembly having a generally circular central portion with a lower surface that provides a substrate mounting surface, and a plurality of independently pressurizable chambers formed between the base assembly and the flexible membrane, comprising an annular outer chamber and a non-circular inner chamber, is provided.

20 Claims, 9 Drawing Sheets

(56) References Cited

U.S. PATENT DOCUMENTS

| | | | | |
|---|---|---|---|---|
| 6,855,043 | B1 | 2/2005 | Tang et al. | |
| 6,857,945 | B1 | 2/2005 | Chen et al. | |
| 6,857,946 | B2 | 2/2005 | Zuniga et al. | |
| 6,872,130 | B1 | 3/2005 | Zuniga | |
| 6,890,249 | B1 | 5/2005 | Zuniga et al. | |
| 6,923,714 | B1 | 8/2005 | Zuniga et al. | |
| 6,979,250 | B2 | 12/2005 | Zuniga et al. | |
| 7,001,245 | B2 | 2/2006 | Chen | |
| 7,001,256 | B2 | 2/2006 | Zuniga et al. | |
| 7,001,257 | B2 | 2/2006 | Chen et al. | |
| 7,040,971 | B2 | 5/2006 | Zuniga et al. | |
| 7,101,273 | B2 | 9/2006 | Tseng et al. | |
| 7,198,561 | B2 | 4/2007 | Chen et al. | |
| 7,207,871 | B1 | 4/2007 | Zuniga et al. | |
| 7,255,771 | B2 | 8/2007 | Chen et al. | |
| 7,867,063 | B2 | 1/2011 | Togawa et al. | |
| 8,460,067 | B2 * | 6/2013 | Chen et al. | 451/288 |
| 2002/0017365 | A1 | 2/2002 | Gunji et al. | |
| 2002/0081956 | A1 | 6/2002 | Bennett et al. | |
| 2005/0042875 | A1 | 2/2005 | Custer et al. | |
| 2005/0245181 | A1 | 11/2005 | Chen et al. | |
| 2006/0105685 | A1 | 5/2006 | Kajiwara et al. | |
| 2007/0289124 | A1 | 12/2007 | Oh et al. | |

FOREIGN PATENT DOCUMENTS

| | | | |
|---|---|---|---|
| CN | 101444897 | | 6/2009 |
| JP | 2000-296457 | A | 10/2000 |
| JP | 2003-224095 | A | 8/2003 |
| JP | 2004-154874 | | 6/2004 |
| JP | 2004-221566 | A | 8/2004 |
| KR | 20020091325 | A | 12/2002 |

OTHER PUBLICATIONS

Office Action for Chinese Application No. 201080003356.0 dated Apr. 8, 2014.

Office Action for Japanese Application No. 2012-510818 dated Apr. 1, 2014.

International Preliminary Report on Patentability for International Application No. PCT/US10/31802 dated Nov. 24, 2011.

Office Action for U.S. Appl. No. 12/720,893 dated Oct. 15, 2012.

Notice of Allowance for U.S. Appl. No. 12/720,893 dated Feb. 20, 2013.

International Search Report and Written Opinion dated Nov. 10, 2010 in PCT/US2010/031802.

* cited by examiner

POLISHING HEAD ZONE BOUNDARY SMOOTHING

CROSS-REFERENCE TO RELATED APPLICATIONS

This application is a divisional of co-pending U.S. patent application Ser. No. 12/720,893, filed Mar. 10, 2010, which claims benefit of U.S. Provisional Patent Application Ser. No. 61/178,218, filed May 14, 2009, which is herein incorporated by reference.

BACKGROUND OF THE INVENTION

1. Field of the Invention

Embodiments of the present invention generally relate to chemical mechanical polishing of substrates, and more particularly to a carrier head for use in chemical mechanical polishing.

2. Description of the Related Art

In the semiconductor manufacturing industry, planarization is a process of removing material from a substrate for smoothing a surface of the substrate, thinning an exposed layer, or exposing layers beneath the surface of the substrate. Substrates typically undergo planarization after one or more deposition processes builds layers of material on the substrate. In one such process, openings are formed in a field region of the substrate and filled with metal by a plating process such as electroplating. The metal fills the openings to create features, such as wires or contacts, in the surface. Although it is desired that the openings be filled with metal only to the level of the surrounding substrate, deposition occurs on the field region as well as the openings. This extra unwanted deposition must be removed, and planarization is the method of choice for removing the excess metal.

Chemical Mechanical Planarization (CMP) is one of the more common types of planarization processes. A substrate is mounted on a carrier head or polishing head and scrubbed with an abrasive pad or web. The substrate may be rotated against a web as the web is translated linearly beneath the substrate, or the substrate may be rotated against a pad while the pad is also rotated in the same or opposite direction, translated linearly, translated in a circular motion, or any combination of these. An abrasive composition is frequently added to the scrubbing pad to accelerate material removal. The composition typically contains abrasive materials to scour the substrate, and chemicals to dissolve material from the substrate surface. In the case of Electro-Chemical Mechanical Planarization, a voltage is also applied to the substrate to accelerate removal of material by electrochemical means.

Some carrier heads include a flexible membrane with a mounting surface that receives a substrate. A chamber behind the flexible membrane is pressurized to cause the membrane to expand outwardly and apply a load to the substrate. Many carrier heads also include a retaining ring that surrounds the substrate, e.g., to hold the substrate in the carrier head beneath the flexible membrane. Some carrier heads include multiple chambers to provide different pressures to different regions of the substrate.

An objective of CMP is to remove a predictable amount of material while achieving uniform surface topography both within each wafer and from wafer to wafer when performing a polishing process.

Therefore, there is a need for improved methods and apparatus for polishing substrates.

SUMMARY OF THE INVENTION

Embodiments of the present invention generally relate to chemical mechanical polishing of substrates, and more particularly to a carrier head for use in chemical mechanical polishing. In one embodiment a carrier head assembly capable of rotation about a centerline for chemical mechanical polishing of a substrate is provided. The carrier head assembly comprises a base assembly for providing support to the substrate, a flexible membrane mounted on the base assembly having a circular central portion with a lower surface that provides a substrate mounting surface, and a plurality of independently pressurizable chambers formed by the volume between the base assembly and the flexible membrane comprising an annular outer chamber and a non-circular inner chamber.

In another embodiment a carrier head assembly capable of rotation about a centerline for chemical mechanical polishing of a substrate is provided. The carrier head assembly comprises a base assembly for providing support to the substrate, a flexible membrane mounted on the base assembly having a generally circular central portion with a lower surface that provides a substrate mounting surface, and a plurality of independently pressurizable chambers formed by the volume between the base assembly and the flexible membrane comprising an annular outer chamber and a non-concentric inner chamber.

In yet another embodiment a flexible membrane for coupling with a base assembly of a chemical mechanical polishing carrier head assembly is provided. The flexible membrane comprises a central portion having an inner surface and an outer surface that provides a mounting surface for a substrate, an annular perimeter portion that extends away from the mounting surface for coupling with the base assembly, and one or more non-circular inner flaps that extend from the inner surface of the central portion, wherein the one or more non-circular inner flaps are configured for coupling with the base assembly to divide the volume between the membrane and the base assembly into independently pressurizable chambers.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

Embodiments of the present invention generally relate to chemical mechanical polishing of substrates, and more particularly to a carrier had for use in chemical mechanical polishing.

Figure 1A:
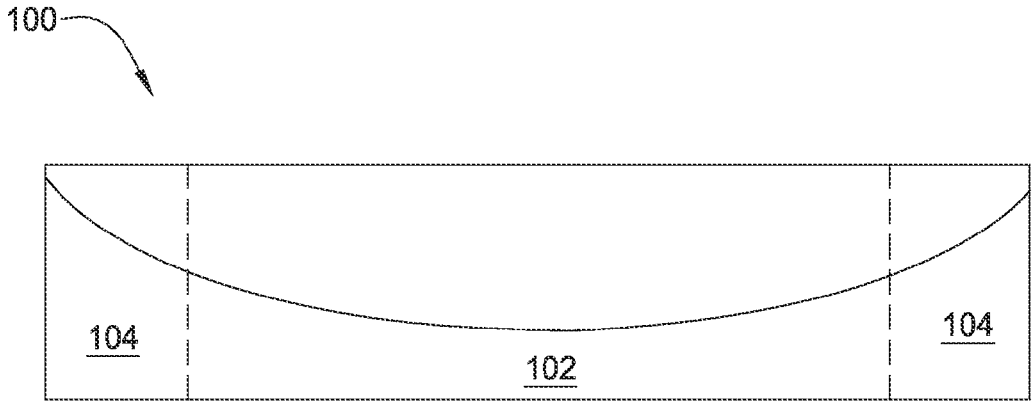
FIG. 1A (PRIOR ART)
FIG. 1A is a schematic view of a polishing profile of a substrate after a prior art chemical mechanical polishing process.
Figure 1B:
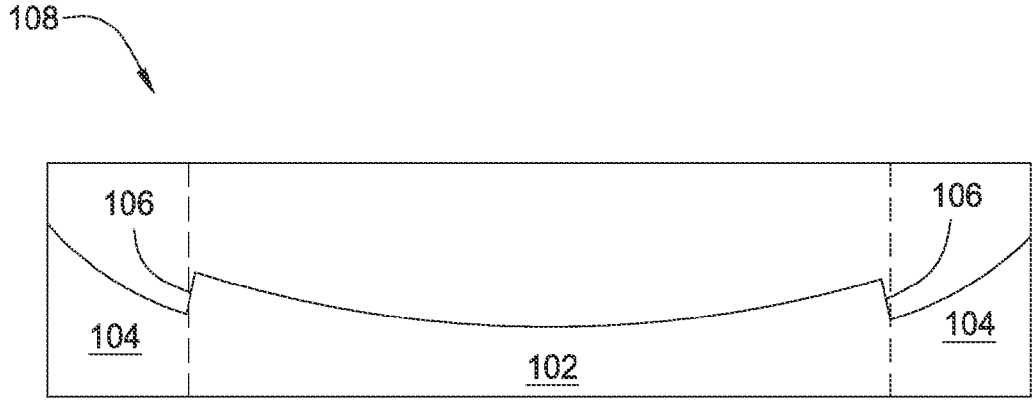
FIG. 1B (PRIOR ART)
FIG. 1B is a schematic view of a polishing profile of a substrate after a chemical mechanical polishing process performed with previously known carrier heads and polishing techniques.

FIG. 1A is a schematic view of a polishing profile 100 of a substrate after a typical chemical mechanical polishing process. FIG. 1B is a schematic view of a polishing profile 108 of a substrate after another typical chemical mechanical polishing process using known carrier heads and polishing techniques. FIG. 1A demonstrates a typical substrate polishing profile 100 for a two pressure concentric circular zone carrier head where the center zone 102 of the substrate polishes at a faster rate than the edge zone 104 of the substrate. In order to compensate for the polishing profile 100 that is center fast as shown in FIG. 1A, the typical response is to apply higher pressure to the edge zone 104 which shifts the profile of the edge zone 104 downward, as shown in FIG. 1B, matching the average thickness between the edge zone 104 and the center zone 102. However, applying higher pressure to the edge zone 104 results in a sharp boundary transition 106 between the center zone 102 and the edge zone 104. As shown in FIG. 1B, the sharp boundary transition 106 or "pressure spike" produces unintended non-uniformities in the polishing profiles. Thus it is desirable to reduce or eliminate these sharp boundary transitions to provide a more uniform polishing profile.

The sharp boundary transition 106 may be reduced or eliminated by taking advantage of the rotation of the substrate relative to the carrier head membrane to create smoother boundary transitions. Altering the pressure zone location and/or geometry of the pressure zone in the carrier head assembly helps achieve a smoother boundary transition. As discussed herein, the non-uniform rotational motion of the substrate relative to the membrane of the carrier head assembly will average out sharp boundary transitions. In one embodiment, at least one pressure zone in the carrier head assembly is non-circular. Non-circular is defined as not having the shape or form of a circle. As the substrate slips and rotates about the non-circular pressure zone, the sharp boundary transition between the pressure zones is averaged out resulting in a smoother zone boundary transition. Non-circular shaped zones including ovals, triangles, squares, and stars have a similar effect on the zone boundary transition. In another embodiment, at least one pressure zone is positioned off-center or non-concentric relative to a centerline of the membrane or axis of rotation of the carrier head. The sharp boundaries may be smoothed out by relying on the substrate rotation relative to the membrane.

While the particular apparatus in which the embodiments described herein can be practiced is not limited, it is particularly beneficial to practice the embodiments in a REFLEXION® CMP system, REFLEXION® LK CMP system, or a MIRRA MESA® system sold by Applied Materials, Inc., Santa Clara, Calif. Additionally, CMP systems available from other manufacturers may also benefit from embodiments described herein. A description of a suitable CMP apparatus can be found in U.S. Pat. No. 5,738,574. Embodiments described herein may also be practiced on overhead circular track polishing systems.

Figure 2:
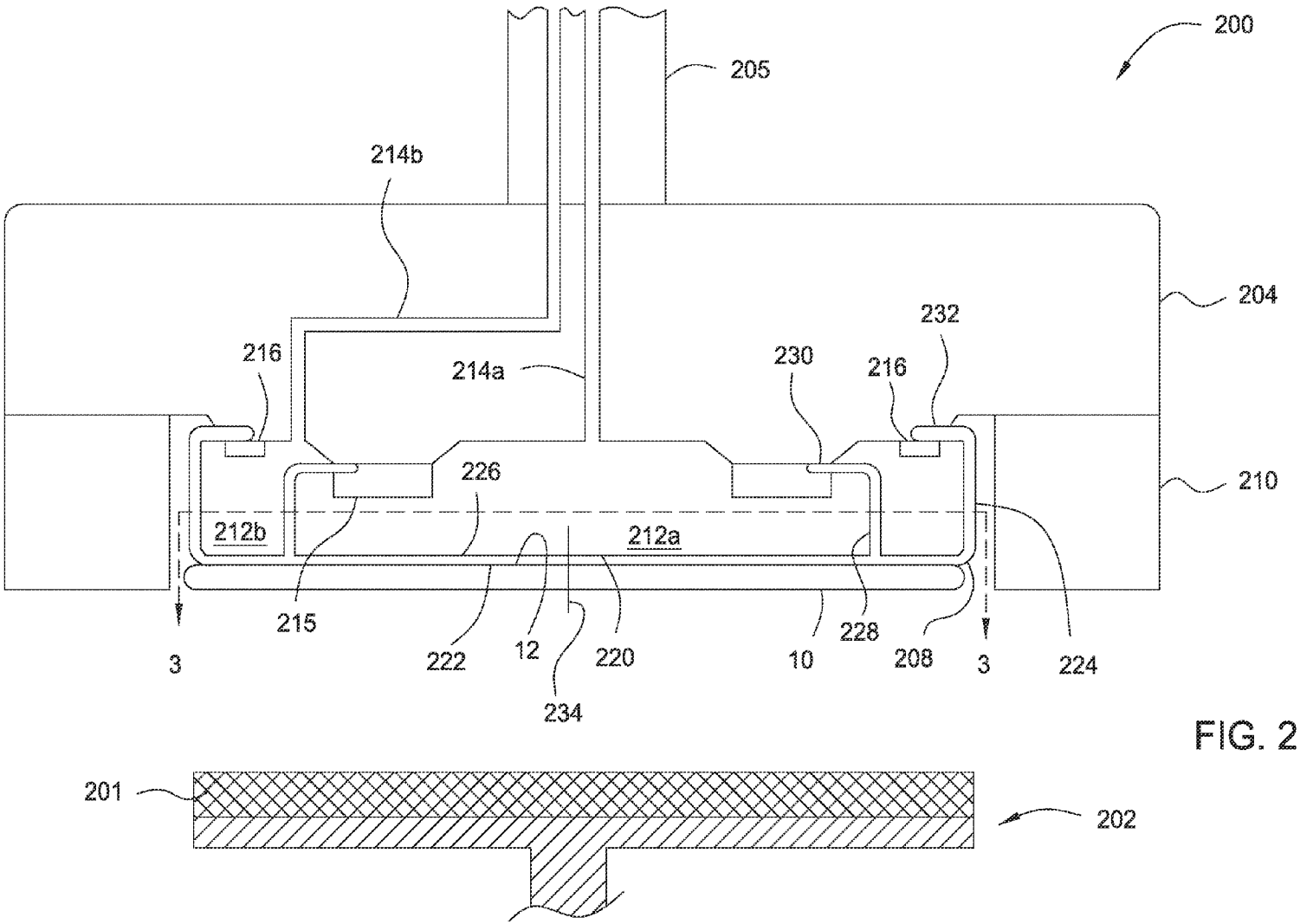
FIG. 2 is a cross sectional view of one embodiment of a carrier head assembly.

FIG. 2 is a cross sectional view of one embodiment of a carrier head assembly 200. The carrier head assembly 200 is generally configured to hold a substrate 10 during polishing or other processing. In a polishing process, the carrier head assembly 200 may hold the substrate 10 against a polishing pad 201 supported by a rotatable platen assembly 202 and distribute a downward pressure across a back surface 12 of the substrate 10.

The carrier head assembly 200 includes a base assembly 204 (which may be coupled directly or indirectly with a rotatable drive shaft 205), a retaining ring 210, and a flexible membrane 208. The flexible membrane 208 extends below and is coupled with the base assembly 204 to provide multiple pressurizable chambers, including a non-circular inner chamber 212*a* and an adjacent outer chamber 212*b*. Passages 214*a* and 214*b* are formed through the base assembly 204 to fluidly couple the chambers 212*a* and 212*b*, respectively to pressure regulators in the polishing apparatus. Although FIG. 2 illustrates two pressurizable chambers, the carrier head assembly 200 could have any number of chambers, for example, three, four, five, or more chambers.

Although not shown, the carrier head assembly 200 can include other elements, such as a housing that is securable to the drive shaft 205 and from which the base 204 is movably suspended, a gimbal mechanism (which may be considered part of the base assembly) that allows the base assembly 204 to pivot, a loading chamber between the base 204 and the housing, one or more support structures inside the chambers 212*a* and 212*b*, or one or more internal membranes that contact the inner surface of the flexible membrane 208 to apply supplemental pressure to the substrate. For example, the carrier head assembly 200 can be constructed as described in U.S. Pat. No. 6,183,354, issued Feb. 6, 2001, or in U.S. Pat. No. 6,422,927, issued Jul. 23, 2002, or in U.S. Pat. No. 6,857,945, issued Feb. 22, 2005.

The flexible membrane 208 may be hydrophobic, durable, and chemically inert in relation to the polishing process. The flexible membrane 208 can include a central portion 220 with an outer surface that provides a mounting surface 222 for a substrate, an annular perimeter portion 224 that extends away from the mounting surface 222 for connection to the base assembly 204, and one or more non-circular inner flaps 228 that extend from the inner surface 226 of the central portion 220 and are connected to the base 204 to divide the volume between the flexible membrane 208 and the base 204 into the independently pressurizable non-circular inner chamber 212*a* and the outer annular chamber 212*b*. In one embodiment, the non-circular inner flaps 228 and the annular perimeter portion 224 are concentric relative to a centerline 234 of the carrier head assembly 208. In one embodiment, the non-circular inner flaps 228 and the annular perimeter portion 224 are concentric relative to a center of the flexible membrane 208. An outer edge 230 of the flap 228 may be secured to the base 204 by an annular clamp ring 215 (which may be considered part of the base 204). An outer edge 232 of the annular perimeter portion 224 may also be secured to the base 204 by annular clamp ring 216 (which also may be considered part of the base 204), or the end of the perimeter portion may be clamped between the retaining ring and the base. Although FIG. 2 illustrates one flap 228, the carrier head assembly 200 could have multiple flaps corresponding to the number of desired pressurizable chambers.

Figure 3:
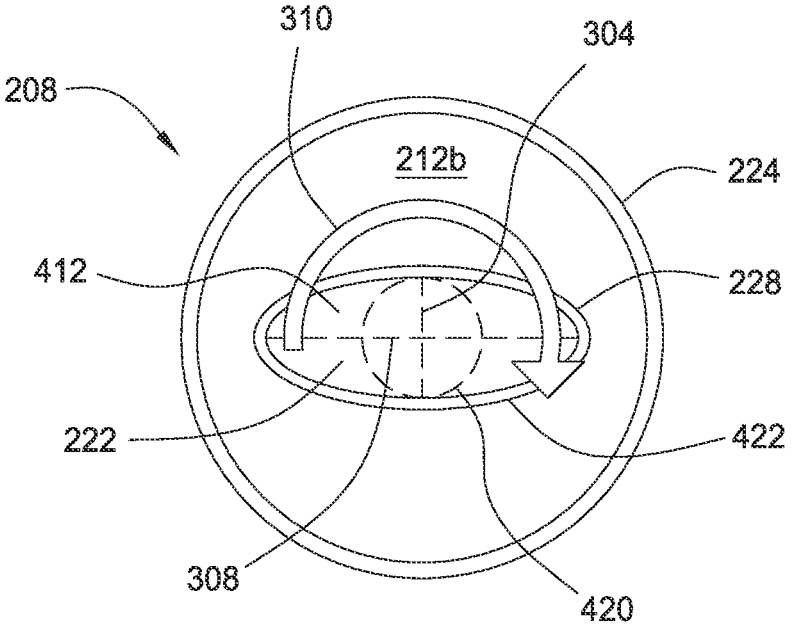
FIG. 3 is a cross-sectional top view of one embodiment of a flexible membrane of the carrier head assembly of FIG. 2 taken along line 3-3 of FIG. 2.

FIG. 3 is a cross-sectional top view of one embodiment of a flexible membrane 208 of the carrier head assembly 200 of FIG. 2 taken along line 3-3 of FIG. 2. The non-circular inner chamber 212*a* is formed by the non-circular inner flap 228. The concentric outer chamber 212*b* is bordered by the non-circular inner flap 228 and the annular perimeter portion 224 of the flexible membrane 208. Each chamber 212*a*, 212*b* is individually pressurizable to the same or different pressures. Although the non-circular inner chamber 212*a* is described as an oval inner chamber, it should be understood that other non-circular chambers may be used to reduce the sharp transition boundary between a center zone and an edge zone.

Figure 4:
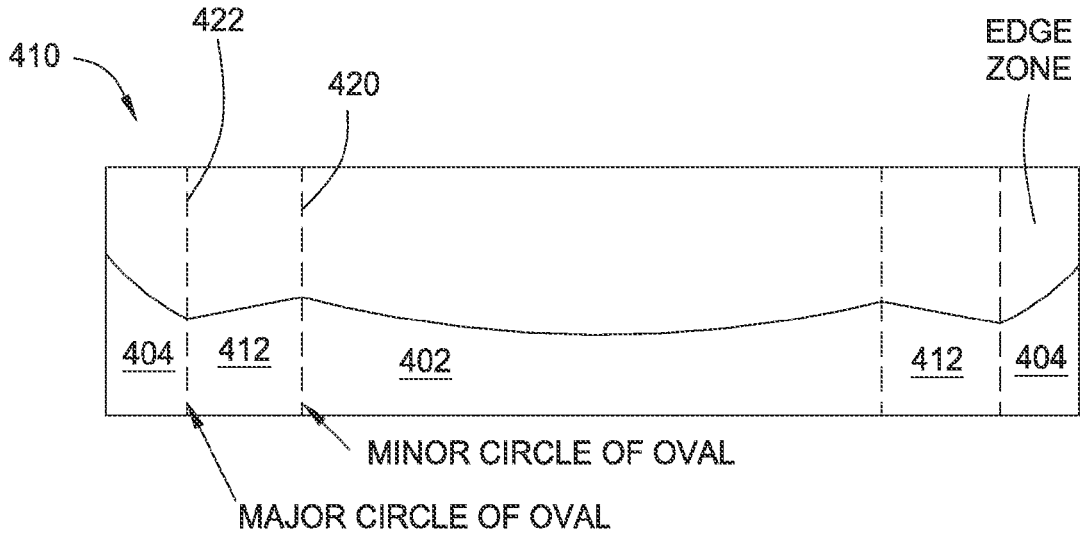
FIG. 4 is a schematic view of a polishing profile of a substrate after a chemical mechanical polishing process performed with a carrier head assembly and polishing techniques according to embodiments described herein.

FIG. 4 is a schematic view of a polishing profile 410 of a substrate after a chemical mechanical polishing process performed with a carrier head assembly and polishing techniques according to embodiments described herein. The polishing profile 410 shows a center zone 402, an edge zone 404, and a transition zone 412 positioned between the center zone 402 and the edge zone 404. A comparison of the polishing profile 108 of FIG. 1B with the polishing profile 410 of FIG. 4 shows that the sharp boundary transition 106 of FIG. 1B is replaced by a smoother transition zone 412 between the center zone 402 and the edge zone 404 thus reducing or eliminating the sharp boundary transition present in prior art polishing processes.

With reference to FIG. 2, FIG. 3, and FIG. 4, the non-circular inner chamber 212*a* has a minor axis 304 and a major axis 308. As the carrier head assembly 200 rotates, the substrate remains stationary relative to the flexible membrane 208; however, the substrate occasionally slips relative to the flexible membrane 208 as shown by arrow 310. The transition zone 412 is created as the substrate slips across the area in between the minor axis 304 and the major axis 308 essentially creating the transition zone 412 bordered by an inner transition boundary 420 and an outer transition boundary 422 that is not fixed. As the substrate 10 slips relative to the carrier head assembly 200 the oval zone slips across the substrate. The center zone 402 of the substrate is exposed to a constant pressure regardless of slippage between the substrate and the flexible membrane and the transition zone 412 of the substrate is occasionally exposed to the area between the minor axis 304 and the major axis 308 of the oval.

Figure 5:
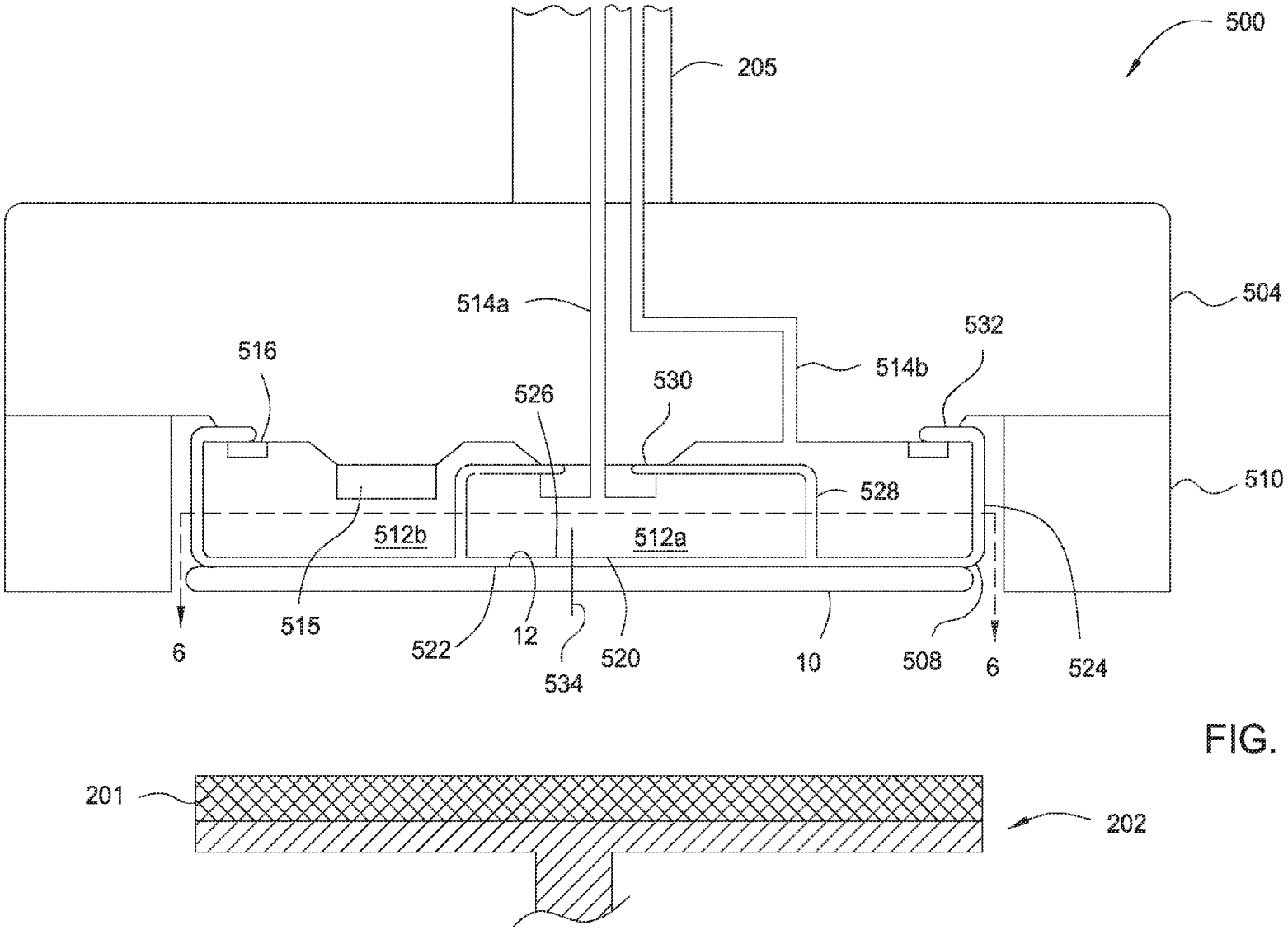
FIG. 5 is a cross sectional view of another embodiment of a carrier head assembly.

FIG. 5 is a cross sectional view of another embodiment of a carrier head assembly 500. The carrier head assembly 500 contains an "off-set" or "non-concentric" inner chamber 512*a*. In one embodiment, the non-concentric inner chamber 512*a* is non-concentric relative to a centerline 534 of the carrier head assembly 500. In one embodiment, the non-concentric inner chamber 512*a* is non-concentric relative to a center of the flexible membrane 508. The carrier head assembly 500 includes a base assembly 504 (which may be coupled directly or indirectly with a rotatable drive shaft 205), a retaining ring 510, and a flexible membrane 508. The flexible membrane 508 extends below and is coupled with the base assembly 504 to provide multiple pressurizable chambers, including a non-concentric inner chamber 512*a* having an annular shape and an annular outer chamber 512*b*. Passages 514*a* and 514*b* are formed through the base assembly 504 to fluidly couple the chambers 512*a* and 512*b*, respectively to pressure regulators in the polishing apparatus. Although FIG. 5 illustrates two pressure chambers, the carrier head assembly 500 could have any number of chambers, for example, three, four, five, or more chambers.

The flexible membrane 508 may be hydrophobic, durable, and chemically inert in relation to the polishing process. The flexible membrane 508 can include a central portion 520 with an outer surface that provides a mounting surface 522 for a substrate, an annular perimeter portion 524 that extends away from the polishing surface for connection to the base assembly 504, and one or more annular inner flaps 528 that extend from an inner surface 526 of the central portion 520 of the flexible membrane 508 and are connected to the base 504 to divide the volume between the flexible membrane 508 and the base assembly 504 into the independently pressurizable non-concentric inner chamber 512*a* and the annular outer chamber 512*b*. An outer edge 530 of the flap 528 may be secured to the base assembly 504 by an annular clamp ring 515 (which may be considered part of the base assembly 504). An outer edge 532 of the annular perimeter portion 524 may also be secured to the base 504 by an annular clamp ring 516 (which also may be considered part of the base 504), or the outer edge 532 of the annular perimeter portion 524 may be clamped between the retaining ring 510 and the base assembly 504. Although FIG. 5 illustrates one flap 528 the carrier head assembly 500 could have two or more flaps.

Figure 6:
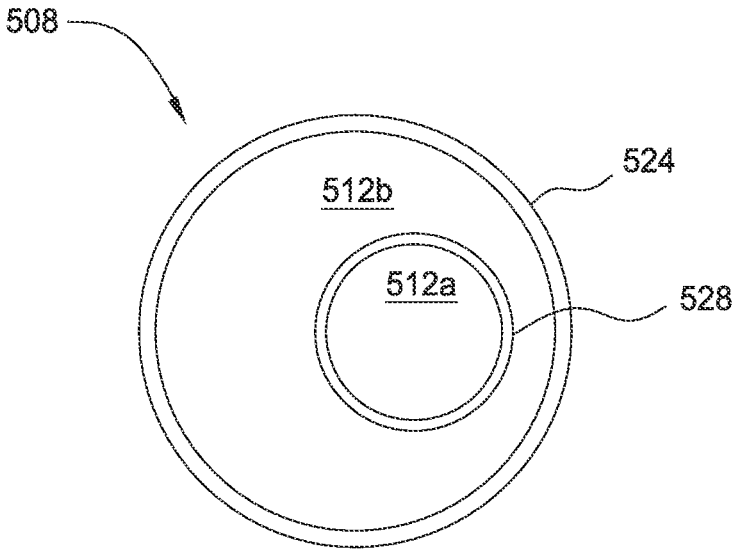
FIG. 6 is a cross-sectional top view of one embodiment of the carrier head assembly of FIG. 5 taken along line 6-6 of FIG. 5.

FIG. 6 is a cross-sectional top view of one embodiment of the carrier head assembly 500 of FIG. 5 taken along line 6-6 of FIG. 5. In one embodiment, the non-concentric inner chamber 512*a* is off-set relative to the center of the flexible membrane 508. The non-concentric inner chamber 512*a* is formed by the annular shaped inner flap 528. The outer chamber 512*b* is bordered by the annular shaped inner flap 528 and the annular perimeter portion 524 of the flexible membrane 508. Each chamber 512*a*, 512*b* is individually pressurizable to the same or different pressures.

Figure 7:
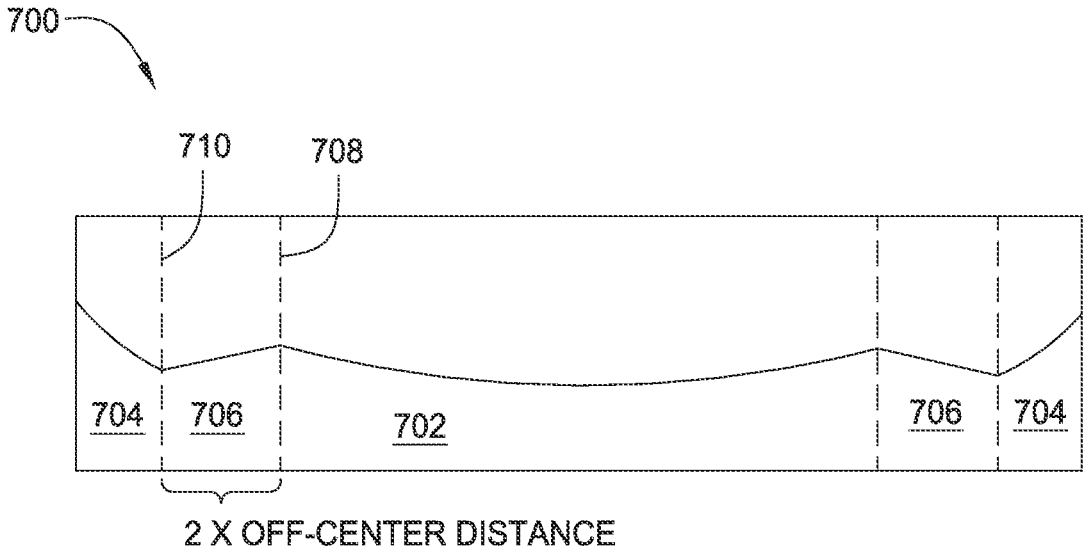
FIG. 7 is a schematic view of a polishing profile of a substrate after a chemical mechanical polishing process performed with a carrier head assembly and polishing techniques according to embodiments described herein.

FIG. 7 is a schematic view of a polishing profile 700 of a substrate after a chemical mechanical polishing process is performed using the carrier head assembly 500 and polishing techniques described herein. The polishing profile 700 shows a center zone 702, an edge zone 704, and a transition zone 706 located between the center zone 702 and the edge zone 704. A comparison of the polishing profile 700 of FIG. 7 with the polishing profile 108 of FIG. 1B shows that the sharp boundary transition 106 of FIG. 1B is replaced by the smoother transition zone 706 thus reducing or eliminating the sharp boundary transition present in prior art polishing processes. An inner transition boundary 708 and an outer transition boundary 710 define the transition zone 706. The center zone 702 is exposed to a portion of the inner chamber 512*a* throughout the polishing process and areas defined by the transition zone 706 are periodically exposed to the inner chamber 512*a* during the polishing process.

Figure 8:
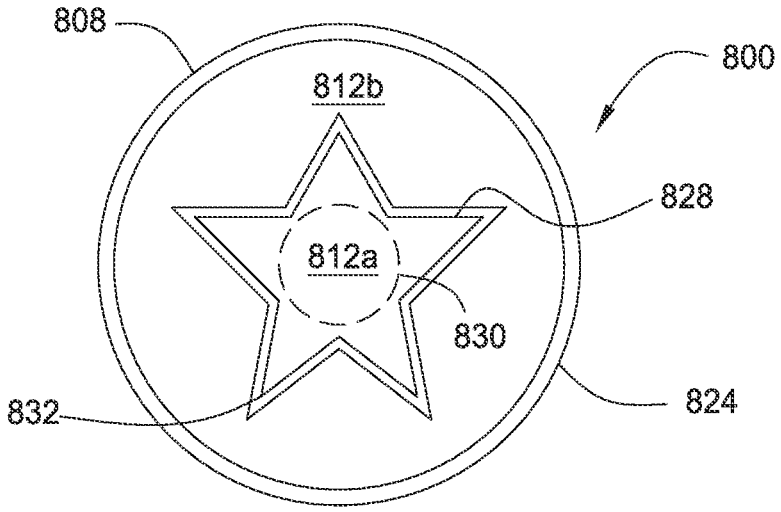
FIG. 8 is a cross sectional top view of another embodiment of a carrier head assembly.

FIG. 8 is a cross sectional top view of another embodiment of a carrier head assembly 800. The carrier head assembly 800 comprises a star-shaped inner chamber 812*a* and an outer circular chamber 812*b*. The star shaped inner chamber 812*a* is formed by a star-shaped flap 828. The outer circular chamber 812*b* is bordered by the star-shaped flap 828 and an annular perimeter portion 824 of a flexible membrane 808. Each chamber 812*a*, 812*b* is individually pressurizable to the same or different pressures. In operation, a center portion 830 of the star-shaped zone formed by the star-shaped flap 828 remains in contact with an area of the backside of the substrate throughout the polishing process while the points 832 of the star-shaped zone formed by the star-shaped flap 828 contact different areas of the substrate periodically throughout the polishing process.

Figure 9:
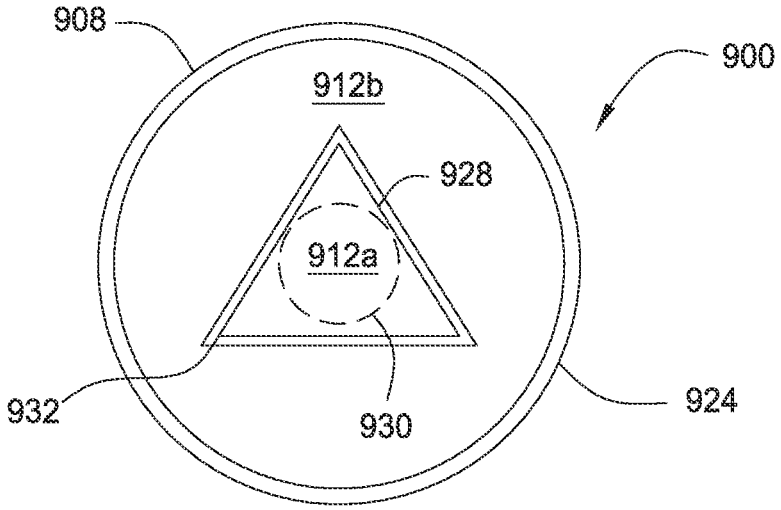
FIG. 9 is a cross sectional top view of another embodiment of a carrier head assembly.

FIG. 9 is a cross sectional top view of another embodiment of a carrier head assembly 900. The carrier head assembly 900 comprises a triangular chamber 912*a* and an outer circular chamber 912*b*. The triangular chamber 912*a* is formed by a star-shaped flap 828. The outer circular chamber 912*b* is bordered by the triangular-shaped flap 928 and by an annular perimeter portion 924 of a flexible membrane 908. Each chamber 912*a*, 912*b* is individually pressurizable to the same or different pressures. In operation, a center portion 930 of the triangular-shaped zone 928 remains in contact with an area of the backside of the substrate throughout the polishing process while the points 932 of the triangular shaped zone 928 contact different areas of the backside of the substrate periodically throughout the polishing process.

Certain embodiments described herein that have non-circular, non-concentric, and/or complex inner reliefs may also include a load transferring material such as, for example, a foam material, as a means of delivering an asymmetric pressure profile to the substrate. As it is compressed, the load transferring material transfers the load to the substrate. In certain embodiments, the load transferring material may be used in conjunction with the flexible membranes described herein. In certain embodiments, the load transferring material may be used in lieu of the flexible membranes described herein where the load transferring material is designed so it performs similarly to the asymmetric flexible membranes described herein.

In certain embodiments, the load transferring material can be a visco-elastomer with little or no memory so as to provide good load transferring characteristics. In certain embodiments, the load transferring material can be memory foam having a higher density that is temperature sensitive. In certain embodiments, the load transferring material can be memory foam having a lower density that is pressure-sensitive. In certain embodiments, the load transferring material can be a soft polymeric material, such as a polyvinylchloride (PVC). Alternatively, the load transferring material can be a hard polymer, such as a mixture of polyphenylenesulfide (PPS), carbon fibers and polytetrafluoroethylene (FIFE, e.g., Teflon®, available from E.I. Dupont), e.g., with 55%/0135%/10% by weight. Other possible load transferring materials include but are not limited to styrene-maleic anhydride (SMA), polystyrene, polypropylene, polyurethane (thermoset), polyethylene, polyvinyl chloride, and acrylonitrile butadiene styrene.

Figure 10:
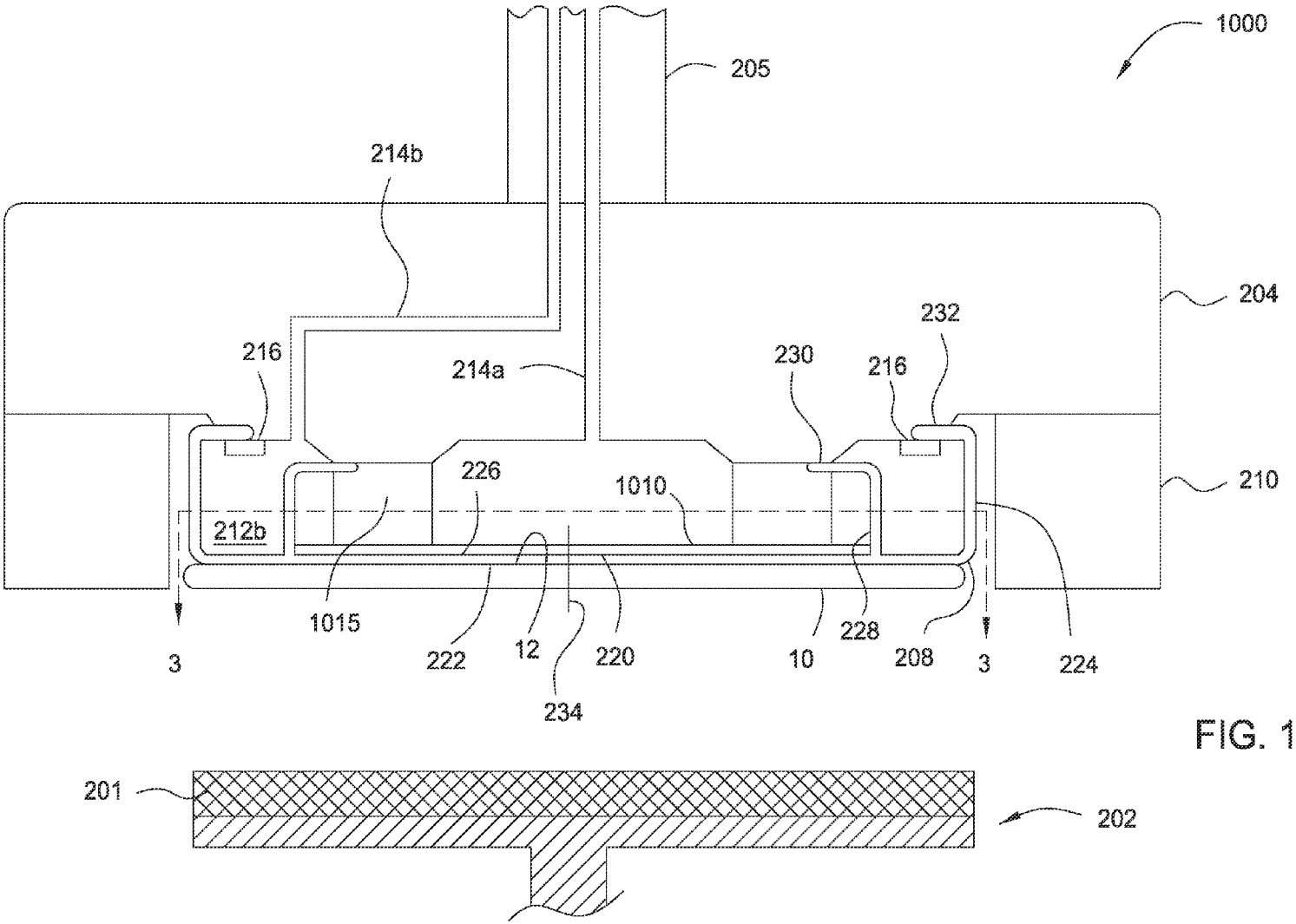
FIG. 10 is a cross sectional view of one embodiment of a carrier head assembly.

FIG. 10 is a cross sectional view of one embodiment of a carrier head assembly 1000. The carrier head assembly 1000 is similar to carrier head 200 of FIG. 2 except for the addition of a load transferring material 1010 in the carrier head assembly 1000 and modification of an annular clamping ring 1015. Although the load transferring material 1010 is shown as positioned in between the annular clamping ring 1015 and the flexible membrane 208, it should be understood that the load transferring material 1010 may be positioned at any location in the carrier head assembly 1000 where the load transferring material helps transfer a load to the substrate. For example, in certain embodiments, the load transferring material may be an integral part of the flexible membrane 208.

In certain embodiment, the thickness of the load transfer material may be varied to provide optimum results in operating conditions that have different loading, carrier head rotation speed, polishing pad rotation speed, load transferring material, and so on.

While the foregoing is directed to embodiments of the present invention, other and further embodiments of the invention may be devised without departing from the basic scope thereof, and the scope thereof is determined by the claims that follow.

The invention claimed is:

1. A carrier head assembly capable of rotation about a centerline for chemical mechanical polishing of a substrate, comprising:

a base assembly configured to provide support for the substrate;

a flexible membrane mounted on the base assembly having a generally circular central portion with a lower surface that provides a mounting surface for a substrate;

an annular outer chamber; and a non-concentric inner chamber, wherein the annular outer chamber and the non-concentric inner chamber are formed between the base assembly and the flexible membrane, the non-concentric inner chamber is non-concentric relative to the centerline, and the annular outer chamber and the non-concentric inner chamber are independently pressurizable.

2. The carrier head assembly of claim 1, wherein the flexible membrane further comprises an annular inner flap that extends from an inner surface of the central portion.

3. The carrier head assembly of claim 2, wherein the flexible membrane further comprises an annular perimeter portion that extends away from the lower surface for connection to the base assembly.

4. The carrier head assembly of claim 3, wherein the annular inner flap is secured to the base assembly to divide the volume between the flexible membrane and the base assembly into the non-concentric inner chamber and the annular outer chamber.

5. The carrier head assembly of claim 4, wherein each of the non-concentric inner chamber and the annular outer chamber are individually pressurizable to the same or different pressures.

6. The carrier head assembly of claim 4, wherein the annular inner flap is secured to the base assembly by a first annular clamp ring.

7. The carrier head assembly of claim 6, wherein the annular perimeter portion of the flexible membrane is secured to the base assembly by a second annular clamp ring.

8. The carrier head assembly of claim 3, wherein the annular perimeter portion is clamped between a retaining ring and the base assembly.

9. The carrier head assembly of claim 2, further comprising a load transferring material positioned within the carrier head assembly for transferring a load to the substrate.

10. The carrier head assembly of claim 9, wherein the load transferring material is positioned in between an annular clamping ring and the flexible membrane.

11. The carrier head assembly of claim 9, wherein the load transferring material is selected from a visco-elastomer, a memory foam that is temperature sensitive, or a memory foam that is pressure sensitive.

12. The carrier head assembly of claim 1, wherein the the flexible membrane further comprises a flap selected from the group consisting of: a star-shaped flap, a triangular-shaped flap, a circular flap, and an oval-shaped flap, secured to the base assembly to define the non-concentric inner chamber.

13. The carrier head assembly of claim 12, wherein the flexible membrane further comprises an annular perimeter portion that extends away from the lower surface for connection to the base assembly, wherein the flap extends from an inner surface of the of the central portion.

14. The carrier head assembly of claim 13, wherein the flap is secured to the base assembly to divide the volume between the flexible membrane and the base assembly into the non-concentric inner chamber and the annular outer chamber.

15. The carrier head assembly of claim 14, wherein each of the non-concentric inner chamber and the annular outer chamber are individually pressurizable to the same or different pressures.

16. The carrier head assembly of claim 14, wherein the flap is secured to the base assembly by a first annular clamp ring.

17. The carrier head assembly of claim 16, wherein the annular perimeter portion of the flexible membrane is secured to the base assembly by a second annular clamp ring.

18. The carrier head assembly of claim 16, wherein the annular perimeter portion is clamped between a retaining ring and the base assembly.

19. The carrier head assembly of claim 18, further comprising a load transferring material positioned within the carrier head assembly for transferring a load to the substrate.

20. The carrier head assembly of claim 19, wherein the load transferring material is positioned in between an annular clamping ring and the flexible membrane.

* * * * *

UNITED STATES PATENT AND TRADEMARK OFFICE

CERTIFICATE OF CORRECTION

PATENT NO. : 9,050,699 B2
APPLICATION NO. : 13/893030
DATED : June 9, 2015
INVENTOR(S) : Chen et al.

It is certified that error appears in the above-identified patent and that said Letters Patent is hereby corrected as shown below:

In the specification

Column 7, Lines 46-47, please delete "(FIFE, e.g., Teflon®, available from E.I. DuPont)" and insert --(PTFE, e.g., Teflon®, available from E.I. DuPont)-- therefor;

Column 7, Lines 47-48, please delete "55%/0135%/10%" and insert --55%/35%/10%-- therefor.

Signed and Sealed this
Eighth Day of December, 2015

Michelle K. Lee

Michelle K. Lee
*Director of the United States Patent and Trademark Office*